US006868238B2

(12) United States Patent
Rodriguez

(10) Patent No.: US 6,868,238 B2
(45) Date of Patent: Mar. 15, 2005

(54) IMAGE FORMING DEVICES, IMAGE FORMING DEVICE FABRICATION METHODS AND IMAGE FORMING DEVICE OPERATIONAL METHODS

(75) Inventor: Santiago Rodriguez, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/423,538

(22) Filed: Apr. 24, 2003

(65) Prior Publication Data

US 2004/0213592 A1 Oct. 28, 2004

(51) Int. Cl.[7] ..... G03G 15/00; G03G 15/08
(52) U.S. Cl. ..... 399/24; 399/27
(58) Field of Search ..... 399/24, 27, 85

(56) References Cited

U.S. PATENT DOCUMENTS 5,483,625 A 1/1996 Robertson et al.
6,223,414 B1 * 5/2001 Hodek et al. ..... 29/527.1
6,332,062 B1 * 12/2001 Phillips et al. ..... 399/12
6,516,160 B1 2/2003 Rodriguez
6,625,402 B2 * 9/2003 Takemoto ..... 399/8

FOREIGN PATENT DOCUMENTS

JP 59162573 A * 9/1984 ..... G03G/15/04
JP 10078740 A * 3/1998 ..... G03G/21/18

* cited by examiner

*Primary Examiner*—Quana Grainger

(57) ABSTRACT

Image forming devices, image forming device fabrication methods and image forming device operational methods are described. In one embodiment, an image forming device includes an image engine configured to use a consumable to form hard images, and circuitry configured to control imaging of the hard images using the image engine operating in one of a first operational mode having a first consumable consumption rate and a second operational mode having a second consumable consumption rate different than the first consumable consumption rate, wherein the circuitry is further configured to switch the imaging of the hard images from the first operational mode to the second operational mode to reduce consumption of the consumable and responsive to the presence of a defined device status condition pertinent to the formation of hard images using the image forming device.

30 Claims, 3 Drawing Sheets

IMAGE FORMING DEVICES, IMAGE FORMING DEVICE FABRICATION METHODS AND IMAGE FORMING DEVICE OPERATIONAL METHODS

FIELD OF THE INVENTION

Embodiments of the invention relate to image forming devices, image forming device fabrication methods and image forming device operational methods.

BACKGROUND OF THE INVENTION

Computers, including digital computers, have experienced expansive growth in sophistication and application in recent decades. Utilization of computers is ubiquitous in businesses and homes to assist with business operations, research, communications, etc. In many uses or applications of computing, it may be desired to create hard images of visual images including text, graphics, illustrations, etc. depicted using the monitor of the computer. Accordingly, numerous image forming devices have been created to assist with such hard imaging.

Image forming devices in at least some arrangements are configured to interface with computers via appropriate connections to receive image jobs, configuration commands and other appropriate communications. In addition, with the increasing popularity of networked environments, networked image forming devices are configured to couple with numerous computers to implement hard imaging. Alternatively, image forming devices may be utilized in stand alone applications.

Exemplary image forming device configurations include printers. Numerous printer configurations have been developed to accommodate various business and home usages. Some exemplary image forming device configurations include monochrome printers, color printers, laser printers, ink-jet printers, and impact printers.

Image forming devices may use one or more consumable during imaging operations which are replaced once expended. Imaging operations may cease rendering the device unusable until the consumable is replaced. Numerous design configurations are relatively inflexible with respect to consumable image. For example, some devices may form images at increased rates of consumable usage providing high-quality output despite the fact that a user may only want a draft quality product. Other devices may enter a lock-out state of operation preventing operation of an image forming device responsive to a determination that a consumable is running low even though some of the consumable remains. At least some embodiments described herein overcome these and other problems with respect to consumable usage and/or replenishment.

SUMMARY OF THE INVENTION

Embodiments of the invention relate to image forming devices, image forming device fabrication methods and image forming device operational methods.

According to one embodiment of the invention, an image forming device comprises, an image engine configured to use a consumable to form hard images, and circuitry configured to control imaging of the hard images using the image engine operating in one of a first operational mode having a first consumable consumption rate and a second operational mode having a second consumable consumption rate different than the first consumable consumption rate, wherein the circuitry is further configured to switch the imaging of the hard images from the first operational mode to the second operational mode to reduce consumption of the consumable and responsive to the presence of a defined device status condition pertinent to the formation of hard images using the image forming device.

According to another embodiment of the invention, an image forming device fabrication method comprises providing an image engine configured to use a consumable to form hard images, first configuring circuitry to control imaging of the hard images in a plurality of operational modes having a plurality of different consumable consumption rates, and second configuring the circuitry to switch the imaging of the hard images from imaging during one of the plurality of operational modes to another of the operational modes to reduce consumption of the consumable and responsive to the presence of a defined device status condition.

According to yet another embodiment, an image forming device operational method comprises providing an image forming device configured to use a consumable to form a hard image, controlling the image forming device to initially operate in a first operational mode having a first consumable consumption rate, detecting the presence of a defined device status condition pertinent to the formation of hard images using the image forming device, and controlling the image forming device to operate in a second operational mode having a second consumable consumption rate different than the first consumable consumption rate responsive to the detecting the presence of the defined device status condition.

Other embodiments are provided, some of which are disclosed herein.

DETAILED DESCRIPTION OF THE INVENTION

Figure 1:
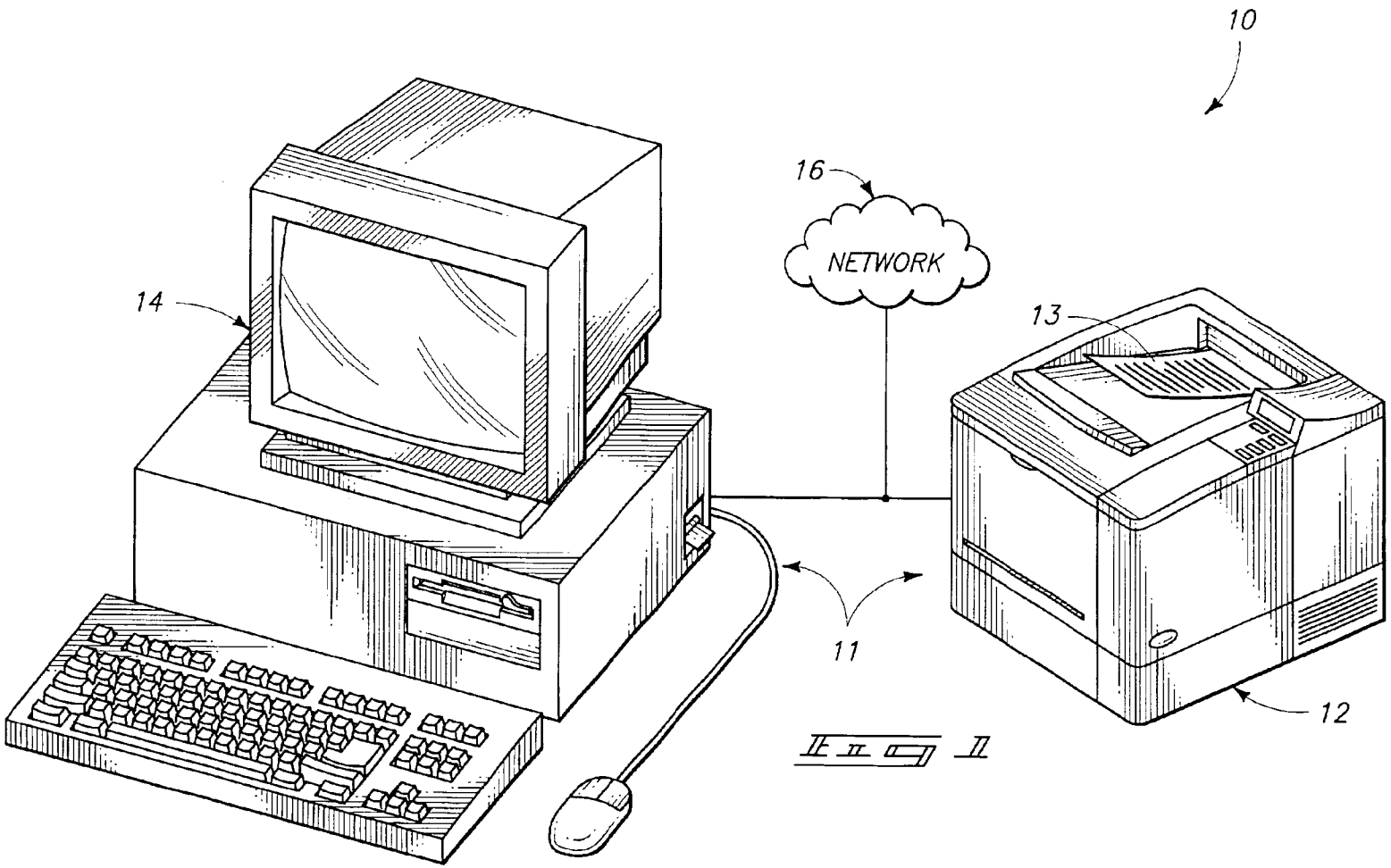
FIG. 1 is a graphical representation of an exemplary computer network environment including an image forming system according to an exemplary embodiment.

FIG. 1 depicts an exemplary computer network environment 10 including an image forming system 11. The image forming system 11 includes one or more image forming device 12 and one or more host device 14 (only one image forming device and one host device are depicted in the exemplary arrangement of FIG. 1) coupled with a network 16. Image forming device 12 may be arranged to communicate with host device 14 and network 16, and/or to operate as a stand-alone unit.

Image forming device 12 and host device 14 are configured to communicate with one another as well as with devices of network 16 in the illustrated exemplary configuration. An exemplary network 16 includes additional host devices configured to send jobs to and/or communicate with image forming device 12 and may be implemented in a private network arrangement (e.g., an intranet), a public network arrangement (e.g., Internet), or other network configuration, including for example, a combination of public and private devices.

Exemplary image forming devices 12 include printers (e.g., ink-jet, laser, impact, color, monochrome, etc.), facsimile devices, copiers, multiple-function devices, or other devices capable of forming hard images upon imaging media 13. Exemplary hard images include images provided upon output media and comprise printed media in one example.

Image forming device 12 utilizes one or more consumable to form hard images. Consumables are components intended to be replaced or replenished during normal usage. Exemplary consumables utilized within an image forming device 12 implemented as a printer, for example, include imaging media 13 (e.g., paper, transparencies, roll media, etc.), marking agents (e.g., toner, ink), components having fixed life spans (e.g., developing assembly), and other expendable items utilized to complete desired jobs. Typically, a consumable is replaced or replenished upon consumption of a useful life of the consumable. Consumable may refer to an entirety of a consumable assembly including, in an exemplary toner configuration, a toner cartridge housing and toner therein and any associated hardware.

An exemplary host device 14 is implemented as a personal computer having an Intel™ processor or AMD™ processor (not shown), for example. Other host device 14 configurations are possible. Host device 14 provides jobs comprising image data to be imaged (e.g., textual information, graphical information, etc.) to image forming device 12 in the exemplary embodiment. In addition, devices of network 16 may also supply image data to image forming device 12 for the generation of hard images. Host device 14 or networked devices may also be utilized to reconfigure or control operations of image forming device 12, using respective printer driver software, for example. Alternatively, or in addition to receiving external image data, image data may be generated or otherwise originated internally of image forming device 12.

Figure 2:
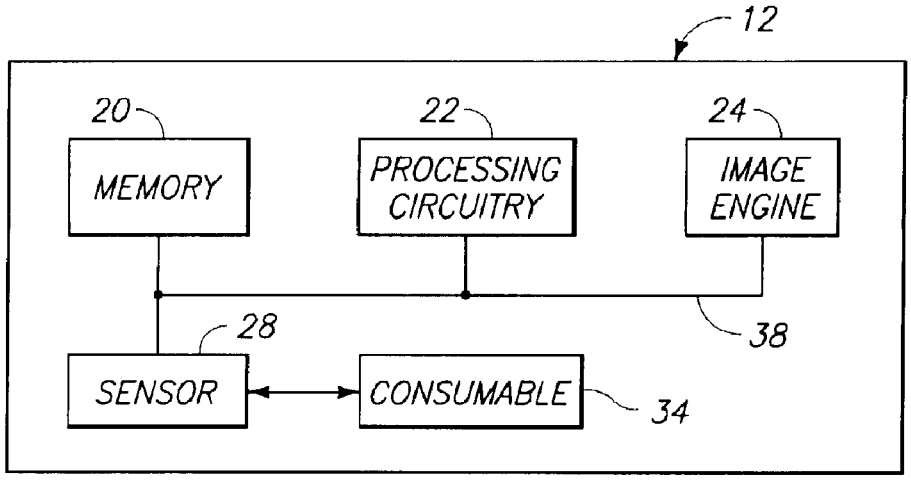
FIG. 2 is a functional block diagram depicting components of an exemplary image forming device of an image forming system according to an exemplary embodiment.

Referring to FIG. 2, components of an exemplary image forming device 12 are depicted. The exemplary embodiments disclosed herein are discussed with reference to a printer application wherein device 12 is implemented as a printer (such as a LaserJet 4100™ laser printer or a LaserJet 9000™ laser printer both available from Hewlett-Packard Company) although the present invention applies to any image forming device configuration capable of forming hard images. In addition, some of the depicted components of FIG. 2 are optional and other arrangements of image forming device 12 including other structural implementations configured to form hard images are possible.

As shown, the exemplary image forming device 12 includes a memory 20, processing circuitry 22, an image engine 24, a sensor 28, and a consumable 34. A bus 38 is configured to implement bi-directional communications between appropriate components of image forming device 12.

Memory 20 is configured to store executable instructions configured to cause processing circuitry 22 to control operations of image forming device 12. Memory 20 is further configured to store digital data usable within device 12. For example, memory 20 is configured to store image data to be rasterized and imaged using image engine 24, executable instructions usable by processing circuitry 22 to implement imaging operations and to control other operations of image forming device 12, as well as other digital data to be stored within image forming device 12. Exemplary memory comprises a hard disk, random access memory (RAM), read only memory (ROM), and/or flash memory in but one exemplary embodiment.

Processing circuitry 22 is configured to execute executable instructions to control operations of image forming device 12. Processing circuitry 22 is configured to execute executable instructions stored within memory 20 and comprising, for example, software and/or firmware instructions. An exemplary configuration of processing circuitry 22 is a microprocessor implemented upon a formatter board with associated memory 20. Alternatively, processing circuitry 22 may be implemented as hardware, such as CMOS logic, configured to control operations of image forming device 12.

Image engine 24 implements formation of hard images upon media 13. According to the exemplary described printer embodiment, image engine 24 is implemented as a print engine. An exemplary print engine includes a fuser assembly (not shown) configured to form hard images by affixing marking agents of developed images to media 13. Other constructions or embodiments of image engine 24 are possible for forming hard images upon media 13.

Sensor 28 is configured to monitor a status of consumable 34 in the illustrated exemplary structural arrangement. Sensor 28 provides data indicative of a monitored consumable status in the form an electrical output signal in the illustrated exemplary configuration. Sensor 28 may utilize optics for monitoring the status of consumable 34, monitor a mass of consumable 34, or use any appropriate structure or methodology for determining the status of consumable 34.

Exemplary statuses include amount of consumable (e.g., toner) expended, amount of consumable remaining, temporal life of consumable remaining (e.g., life of developing assembly remaining in hours), and/or an amount of time the consumable has been utilized. Consumable status may be expressed or quantified in any other appropriate terms corresponding to the consumable being utilized. Sensor 28 may be provided within individual components of device 12, such as consumable 34.

Processing circuitry 22 is configured to receive the signal from sensor 28 to monitor consumable status. Alternatively, or in addition to utilization of information from sensor 28, processing circuitry 22 monitors consumable status internally by monitoring operations of image forming device 12. For example, processing circuitry 22 may tally the number of sheets imaged since consumable replacement, the number of times a laser has been turned on\off, the number of pixels imaged, etc. Other structure or methods may be utilized to monitor consumable status according to other embodiments of the invention.

It may be desired at times to increase a useable life of consumable 34 of image forming device 12. For example, if a user desires formation of images wherein quality is not a concern (e.g., printing draft documents for internal use), image forming device 12 may be provided within an economy mode also referred to as a reduced consumable consumption mode wherein the number of images which may be imaged is greater than the number of images which may be imaged during operation in a normal mode inasmuch as less consumable is utilized to form an image compared with the normal mode. Hard images produced during the reduced consumable consumption mode are typically of lesser quality than hard images imaged during other operational modes.

For example, in one exemplary reduced consumable consumption mode, voltages used within an electrophotographic process of device 12 may be lowered resulting in a lower density of a consumable comprising toner being provided upon an imaged sheet. According to another reduced consumable consumption mode, borders of formed images (e.g., alphabet letters) may be imaged to typical or normal densities of the marking agent while inner portions of the images defined by the borders may include a less dense quantity of the marking agent resulting in savings of consumable 34. Yet another reduced consumable consumption mode is described in U.S. Pat. No. 5,483,625, incorporated herein by reference, which describes a method and apparatus for adjusting dot or pixel density of a digital image which provides a toner or ink consumable saving mode for high resolution printers. In another embodiment, half tone color tables may be used to reduce a rate of consumption of a consumable. Other reduced consumable consumption modes of operation are contemplated for forming images. Accordingly, image forming device 12 is configured to operate in a plurality of operational modes (normal mode and one or more reduced consumable consumption modes) having a plurality of different respective consumable consumption rates.

In the depicted embodiment, circuitry, such as processing circuitry 22, is provided to control operations of image forming device within the plurality of operational modes. One embodiment provides selection of an appropriate operational mode corresponding to device status conditions. Methodology and structure are disclosed to control operation of device 12 within an appropriate operational mode responsive to device status conditions.

Device status conditions are pertinent to the formation of hard images using image forming device 12. Responsive to detection of a device status condition, operation of device 12 within one of the appropriate operational modes is selected according to some embodiments of the invention. In an exemplary described embodiment, processing circuitry 22 is configured to monitor for the occurrence or presence of a device status condition and to select an appropriate operational mode for device 12 for forming hard images. For example, processing circuitry 22 is configured to switch the formation of hard images from one of the operational modes to another of the operational modes to either reduce or increase a rate of consumable consumption responsive to the presence or detection of a device status condition.

In one exemplary configuration, and upon detection of the occurrence or presence of a device status condition, processing circuitry 22 may alter rasterization processing of image data responsive to switching of the operational modes providing increased or decreased consumption of a consumable for a given image. Alternatively, processing circuitry 22 may alter or supply new control signals to a developing assembly or to image engine 24 to adjust fusing voltages utilized to form hard images to reduce or increase consumable consumption rates, if appropriate. Different color conversion tables may be selected by processing circuitry 22 to alter consumption rates. During the life of a given consumable, operation of device 12 may be switched back and forth a plurality of times between the different operational modes to selectively increase and decrease the consumable consumption rate.

A plurality of device status conditions may be monitored for determining operation in an appropriate one of the plurality of operational modes including normal imaging mode and one or more reduced consumable consumption mode. The examples of device status conditions utilized to control the operational mode of device 12 illustrate embodiments of the present invention including automatic provision of device 12 in a reduced consumable consumption mode or normal mode responsive to one or more defined device status condition. Other device status conditions in addition to those described herein may be utilized to control a mode of operation of device 12.

One exemplary device status condition which may be monitored comprises an image-type indication corresponding to the type of image to be imaged. The content of the image (image data) for a job to be imaged is analyzed to identify the type of image and provide an image-type indication of the image job. For example, the image may be identified as a textual image, graphical image, a combination of text and graphics (e.g., on a percentage basis), or other criteria. Processing circuitry 22 or other appropriate circuitry analyzes the image data to determine and provide the image-type indication. Further exemplary details of an analysis to provide an image-type indication of images to be formed are described in U.S. Pat. No. 6,516,160; and U.S. patent application Ser. No. 09/928,503, entitled "Correction of Pulse Width Accumulator Based on the Image Type Being Printed," and filed Aug. 14, 2001, and the teachings of both references are incorporated herein by reference.

The analysis provides the image-type indications for the images to be formed. Following determination of the appropriate image-type indication for an image job, processing circuitry 22 is configured to compare the determined image-type indication with a defined image-type (e.g., 30% graphics and 70% text) stored for example within memory 20. An appropriate mode of operation may be selected corresponding to a type of document to be imaged. For example, device 12 may be configured such that the reduced consumable consumption mode of operation is automatically utilized responsive to the image data comprising a determined or defined kind of document as indicated by the image-type indication (e.g., full text document, line art document, etc.).

If the analysis provides an image-type indication corresponding to a defined or selected image-type, processing circuitry 22 is configured to in at least one embodiment to switch the formation of hard images from one operational mode to another operational mode to either increase or decrease the consumable consumption during imaging of the image data if device 12 is not already in the appropriate mode. Accordingly, in at least one embodiment of the invention, processing circuitry 22 analyzes jobs to be imaged using device 12, determines the content, format or other appropriate characteristic of the job, and selects the appropriate operational mode responsive to the content of the job.

According to additional embodiments of the invention, other exemplary device status conditions to be monitored include consumable status conditions as monitored by sensor 28, processing circuitry 22 and/or other structure. In accordance with such embodiments, processing circuitry 22 switches the operational mode of image forming device 12 based upon the consumable status conditions. For example, in one embodiment, the status of consumable 34 is monitored and upon status of consumable 34 reaching a defined consumable status condition, the operation of device 12 is automatically switched from one operational mode to another operational mode.

For the exemplary embodiment wherein image forming device 12 is implemented as a printer, consumable 34 being monitored may comprise toner. Image forming device 12 may be programmed via memory 20 upon manufacture or by a customer or at other times, to compare consumable status with one or more defined consumable status condition or level wherein one or more respective consumable consumption mode is utilized. Processing circuitry 22 is configured to monitor the status of consumable 34 reaching a defined consumable status condition (e.g., corresponding to a consumable low status condition) and to automatically switch the mode of operation of image forming device 12 responsive to the detection of the consumable reaching a consumable status condition.

Alternatively, and in accordance with the one printer embodiment, the consumable status being monitored corresponds to an entirety of a toner cartridge. For example, the developing assembly and\or photoconductive drum of a toner cartridge (separate or in addition to monitoring toner level) may be monitored with respect to consumable status conditions for controlling the mode of operation of device 12.

In addition, image forming device 12 may be programmed by a user for desired imaging of jobs. For example, the user could have the option for programming image forming device 12 via an appropriate interface, such as a keypad (not shown), or a printer driver, to operate in a reduced consumable consumption mode responsive to factory defined, user defined, and/or other defined device status conditions. The criteria or device status conditions may be tailored and selected by the appropriate user of image forming device 12. The user may adjust the consumable status condition (e.g., selecting an adjustable value corresponding to a desired status of the consumable when a reduced consumable consumption mode is desired) wherein switching of the mode of operation of device 12 occurs.

One embodiment of the invention enables automatic selection of the appropriate mode of operation without user input. For configurations wherein consumable status is being monitored, the life of the consumable may be extended enabling proper replacement or replenishment of the consumable before the consumable is fully expended. Further, embodiments of the invention provide extended usage of the consumable by selectively reducing imaging quality as described above.

In at least one embodiment, image forming device 12 may operate in a plurality of reduced consumable consumption modes. For example, if consumable status is being monitored to control an operational mode of device 12, a plurality of different consumable status conditions may trigger operations of device 12 in a plurality of respective reduced consumable consumption modes.

One exemplary embodiment is provided for illustration wherein a plurality of consumable status conditions may control operation of device 12 in the plurality of operational modes. If a consumable has a first exemplary status condition of 25% remaining life or greater, the processing circuitry 22 may control the image forming device 12 to operate in a normal mode of operation. If processing circuitry 22 detects the status condition of the consumable reaching less than 25%, the processing circuitry 22 may provide operations of the image forming device 12 within a first reduced consumable consumption mode wherein a consumable is consumed at a rate less than the normal mode to form a given image.

Thereafter, if the status condition of the consumable is determined to reach another defined status condition (e.g., 5% remaining life), the processing circuitry 22 may control the operations of image forming device 12 in another reduced consumable consumption mode. For example, in the another reduced consumable consumption mode, the rate of consumption of a consumable may be reduced even further wherein the consumable is consumed at a rate less than the rate during the first reduced consumable consumption mode to form a given image.

The print quality of images generated may vary from one operational mode compared with another operational mode and corresponding to the respective rate of consumption of the consumable. In one possible implementation, imaging operations of image forming device 12 may be precluded responsive to the detection of a defined device status condition (e.g., consumable status remaining life being 1% or less). Accordingly, a plurality of different or additional operational modes corresponding to respective different or additional device status conditions may be provided in but one embodiment.

In one embodiment, the particular device status conditions being monitored and the respective one or more status used to trigger action by processing circuitry 22 may be adjusted by the user, factory or other entity corresponding to the usage of the device or for other purposes to tailor or provide desired operation of the image forming device 12.

Alternatively or additionally to adjusting the operational mode of device 12, the processing circuitry 22 may initiate the generation of a message for communication to an appropriate party regarding the status of the consumable responsive to the status of the consumable reaching a defined status condition. The communication of the message may be provided with or without adjustment of the operational mode of the image forming device 12. The message may be communicated using an appropriate user interface (not shown) of device 12, communicated via email or other electronic message, via generation of a hard image, and/or other appropriate method to apprise a user of the status of the consumable.

Figure 3:
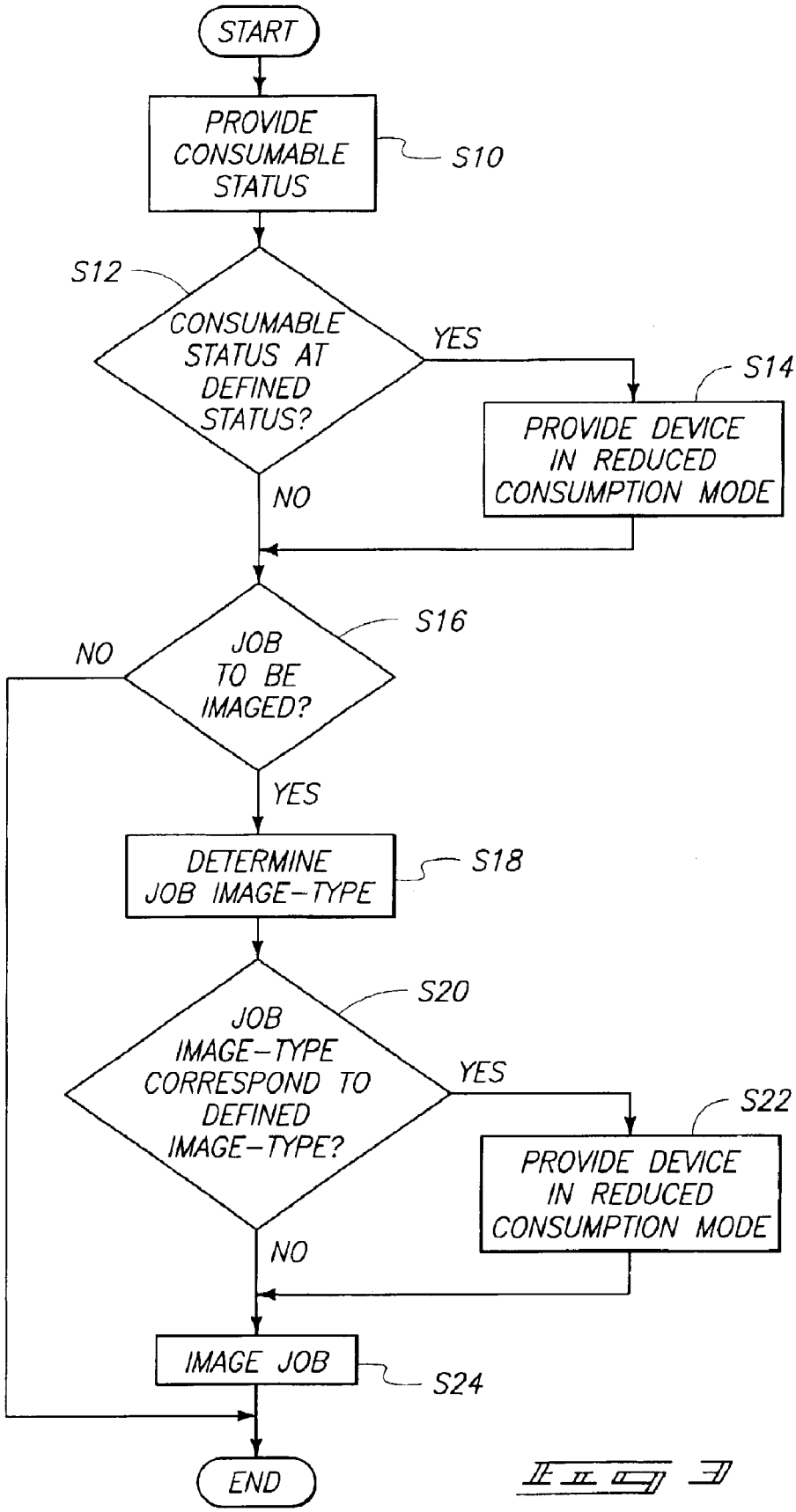
FIG. 3 is a flow chart depicting an exemplary methodology executable within an image forming device according to an exemplary embodiment.

Referring to FIG. 3, an exemplary methodology performed within image forming device 12 is illustrated. Executable instructions may be provided within memory 20 to cause processing circuitry 22 configured as a processor to execute the depicted methods steps. Alternatively, the depicted methodology may be implemented within a hardware arrangement. Some of the illustrated steps may be omitted or other additional steps may be executed according to other possible methods of the present invention.

Initially at a step S10, a consumable status is provided. Processing circuitry 22 may calculate or determine the consumable status, sensor 28 may provide consumable status information and\or other methods may be used to determine the status of an appropriate consumable.

At a step S12, processing circuitry 22 compares the consumable status with one or more consumable status condition stored within memory 20.

If the condition of step S12 indicates that the consumable status is at a defined status, processing circuitry 22 provides image forming device 12 in a reduced consumable consumption mode in step S14. As mentioned above, a plurality of reduced consumable consumption modes may be provided corresponding to a plurality of respective statuses.

At a step S16, it is determined whether there is a current job to be imaged. The current execution of the depicted methodology terminates if the condition of step S16 is negative.

Otherwise, at a step S18, an analysis is performed of the job to be imaged to determine the job image-type comprising textual information, graphical information or a combination of graphical and textual information or other desired content.

At a step S20, it is determined whether the job image-type indication resulting from step S18 corresponds to a defined image-type stored within memory 20 of FIG. 2.

If the condition of step S20 is affirmative, image forming device 12 is provided within an appropriate reduced consumable consumption mode at a step S22. The mode of step S22 may result in similar or different operations of device 12 as specified by the mode of step S14.

Thereafter, or if the condition of step S20 is negative, the job is imaged at a step S24.

The protection sought is not to be limited to the disclosed embodiments, which are given by way of example only, but instead is to be limited only by the scope of the appended claims.

What is claimed is:

1. An image forming device comprising:

an image engine configured to use a consumable to form hard images; and circuitry configured to control imaging of the hard images using the image engine operating in one of a first operational mode having a first consumable consumption rate and a second operational mode having a second consumable consumption rate different than the first consumable consumption rate, wherein the circuitry is further configured to switch the imaging of the hard images from the first operational mode to the second operational mode to reduce consumption of the consumable and responsive to the presence of a defined device status condition pertinent to the formation of hard images using the image forming device.

2. The device of claim 1 wherein the defined device status condition comprises a defined image-type indication and the circuitry is configured to analyze image data of an image to be formed to identify a type of image to be formed, to provide an image-type indication responsive to the analysis and to switch the imaging responsive to the provided image-type indication corresponding to the defined image-type indication.

3. The device of claim 2 wherein the defined image-type indication comprises a defined amount of graphical content and textual content.

4. The device of claim 1 wherein the circuitry is configured to switch the imaging responsive to the defined device status condition comprising a consumable status condition.

5. The device of claim 4 further comprising memory circuitry configured to store the consumable status condition comprising an adjustable value.

6. The device of claim 4 wherein the circuitry is configured to switch the imaging responsive to the consumable status condition comprising a consumable low status condition.

7. The device of claim 1 wherein the image engine comprises a print engine configured to use a marking agent to form hard images, and the consumable low status condition comprises a marking agent low status condition.

8. The device of claim 1 wherein the circuitry is configured to return the imaging to the first operational mode prior to replenishment of the consumable used during initial imaging in the first operational mode and the second operational mode.

9. The device of claim 1 wherein the circuitry is configured to switch the imaging of the hard images from the second operational mode to a third operational mode to further reduce consumption of the consumable and responsive to the presence of another defined device status condition.

10. The device of claim 9 wherein the defined device status conditions comprise different consumable status conditions.

11. The device of claim 1 wherein the circuitry is configured to control the communication of a message externally of the image forming device responsive to the presence of the defined device status condition.

12. An image forming device fabrication method comprising:

providing an image engine configured to use a consumable to form hard images;

first configuring circuitry to control imaging of the hard images in a plurality of operational modes having a plurality of different consumable consumption rates; and second configuring the circuitry to switch the imaging of the hard images from imaging during one of the plurality of operational modes to another of the operational modes to reduce consumption of the consumable and responsive to the presence of a defined device status condition.

13. The method of claim 12 wherein the second configuring comprises configuring the circuitry to switch the imaging responsive to the presence of the defined device status condition comprising a consumable status condition.

14. The method of claim 13 wherein the providing the image engine comprises providing a print engine configured to use the consumable comprising a marking agent and the second configuring comprises configuring the circuitry to switch the imaging responsive to the consumable status condition comprising a marking agent low status condition.

15. The method of claim 12 wherein the second configuring comprises configuring the circuitry to switch the imaging responsive to the presence of the defined device status condition comprising an image-type indication.

16. The method of claim 15 wherein the second configuring comprises configuring the circuitry to switch the imaging responsive to the image-type indication comprising a defined amount of at least one of graphical content and textual content of the image to be formed.

17. An image forming device operational method comprising:

providing an image forming device configured to use a consumable to form a hard image;

controlling the image forming device to initially operate in a first operational mode having a first consumable consumption rate;

detecting the presence of a defined device status condition pertinent to the formation of hard images using the image forming device; and controlling the image forming device to operate in a second operational mode having a second consumable consumption rate different than the first consumable consumption rate responsive to the detecting the presence of the defined device status condition.

18. The method of claim 17 wherein the detecting comprises detecting the presence of a consumable status condition.

19. The method of claim 17 wherein the providing comprises providing a printer configured to use a marking agent to form the hard image.

20. The method of claim 19 wherein the detecting comprises detecting the presence of a consumable status condition comprising a low marking agent condition.

21. The method of claim 17 further comprising setting an adjustable consumable status condition to provide the defined device status condition, and wherein the detecting comprises detecting the presence of a status of the consumable at the adjustable consumable status condition.

22. The method of claim 17 further comprising analyzing image data of an image to be formed to provide an image-type indication, and wherein the detecting comprises detecting the presence of the image-type indication corresponding to a defined image-type indication.

23. The method of claim 17 further comprising controlling the image forming device to operate in the first operational mode after the controlling the image forming device to operate in the second operational mode and prior to replenishment of the consumable used during the operation in the initial first operational mode and the second operational mode.

24. The device of claim 1 wherein the circuitry is configured to switch the imaging from the first operational mode to the second operational mode responsive to analysis of image data of at least one of the hard images.

25. The device of claim 1 wherein the circuitry is configured to automatically switch the imaging from the first operational mode to the second operational mode without user input.

26. The method of claim 12 wherein the second configuring comprises configuring the circuitry to control the switching of the imaging responsive to analysis of image data of at least one of the hard images.

27. The method of claim 12 wherein the second configuring comprises configuring the circuitry to automatically switch the imaging from the one operational mode to the another operational mode without user input.

28. The method of claim 17 wherein the controlling the image forming device to operate in the second operational mode comprises controlling responsive to the detecting comprising detecting an image-type of a hard image to be formed matching the defined device status condition comprising a defined image-type.

29. The method of claim 17 wherein the detecting and the controlling the image forming device to operate in the second operational mode comprise automatically detecting and controlling without user input.

30. The method of claim 12 wherein the defined device status condition is pertinent to the formation of hard images using the image forming device.

* * * * *